US009685696B2

(12) United States Patent
Uchida

(10) Patent No.: US 9,685,696 B2
(45) Date of Patent: Jun. 20, 2017

(54) ANTENNA AND ELECTRONIC DEVICE

(71) Applicant: NEC Platforms, Ltd., Kanagawa (JP)

(72) Inventor: Jun Uchida, Kanagawa (JP)

(73) Assignee: NEC Platforms, LTD., Kanagawa (JP)

( * ) Notice: Subject to any disclaimer, the term of this patent is extended or adjusted under 35 U.S.C. 154(b) by 113 days.

(21) Appl. No.: 14/767,329

(22) PCT Filed: Feb. 19, 2014

(86) PCT No.: PCT/JP2014/000837
§ 371 (c)(1),
(2) Date: Aug. 12, 2015

(87) PCT Pub. No.: WO2014/132590
PCT Pub. Date: Sep. 4, 2014

(65) Prior Publication Data

US 2015/0380809 A1 Dec. 31, 2015

(30) Foreign Application Priority Data

Feb. 26, 2013 (JP) ..... 2013-035234

(51) Int. Cl.
*H01Q 1/38* (2006.01)
*H01Q 7/00* (2006.01)
*H01Q 9/04* (2006.01)

(52) U.S. Cl.
CPC ..... *H01Q 1/38* (2013.01); *H01Q 7/00* (2013.01); *H01Q 9/04* (2013.01)

(58) Field of Classification Search
CPC H01Q 7/00; H01Q 7/005; H01Q 7/02; H01Q 7/04; H01Q 7/06; H01Q 7/08
See application file for complete search history.

(56) References Cited

U.S. PATENT DOCUMENTS

2004/0021463 A1* 2/2004 Miyazawa ..... H01Q 7/00 324/252
2007/0057849 A1 3/2007 Moon et al.
(Continued)

FOREIGN PATENT DOCUMENTS

CN 101072017 A 11/2007
CN 102142617 A 8/2011
(Continued)

OTHER PUBLICATIONS

Office Action issued in Chinese Patent Application No. 201480010421.0, dated Oct. 31, 2016 (10 pages)—English Translation.
(Continued)

*Primary Examiner* — Dameon E Levi
*Assistant Examiner* — Daniel J Munoz
(74) *Attorney, Agent, or Firm* — Wilmer Cutler Pickering Hale and Dorr LLP

(57) ABSTRACT

A split section (6*a*) has an auxiliary conductor pattern (11*a*) formed on one end of a substantially C-shaped section of a first split-ring section, and a split (12*a*) formed between the auxiliary conductor pattern (11*a*) and the other end of the substantially C-shaped section. A split section (6*b*) has an auxiliary conductor pattern (11*b*) formed on one end of a substantially C-shaped section of a second split-ring section, and a split (12*b*) formed between the auxiliary conductor pattern (11*b*) and the other end of the substantially C-shaped section. The auxiliary conductor pattern (11*b*) is formed so as to face the auxiliary conductor pattern (11*a*). The split (12*b*) is formed so as to be opposite from the position facing the split (12*a*) and consequently sandwich the auxiliary conductor pattern (11*b*) therebetween. A split (14) is formed between the auxiliary conductor pattern (11*a*) and the auxiliary conductor pattern (11*b*), stores electrical charges hav-
(Continued)

ing different polarity, and functions as a large-capacity capacitor. As a result, it is possible to inexpensively produce a compact antenna and electric device.

4 Claims, 18 Drawing Sheets

(56) References Cited

U.S. PATENT DOCUMENTS

| | | | | |
|---|---|---|---|---|
| 2011/0032165 | A1 | 2/2011 | Heng et al. | |
| 2012/0280890 | A1 | 11/2012 | Kusumoto | |
| 2013/0207852 | A1* | 8/2013 | Nakano | H01Q 1/2225 343/702 |
| 2014/0203993 | A1* | 7/2014 | Toyao | H01Q 13/10 343/867 |

FOREIGN PATENT DOCUMENTS

| | | | |
|---|---|---|---|
| CN | 202019043 | U | 10/2011 |
| JP | 2007-082170 | A | 3/2007 |
| JP | 2011-525721 | A | 9/2011 |
| WO | WO-2011/086723 | A1 | 7/2011 |

OTHER PUBLICATIONS

International Search Report corresponding to PCT/JP2014/000837, dated May 27, 2014 (3 pages).

* cited by examiner

ANTENNA AND ELECTRONIC DEVICE

CROSS-REFERENCE TO RELATED APPLICATIONS

This application is a national stage application of International Application No. PCT/JP2014/000837 entitled "Antenna and Electronic Device," filed on Feb. 19, 2014, and Japanese Patent Application No. 2013-035234, filed on Feb. 26, 2013, the disclosure of each which are hereby incorporated by reference in their entirety.

TECHNICAL FIELD

The invention relates to an antenna and an electronic device.

BACKGROUND ART

It becomes clear to be able to control propagation characteristics of an electromagnetic wave by periodically arranging conductor patterns having specific structure (hereinafter, referred to as metamaterial). As the most basic structural element in the metamaterial, a split-ring resonator which employs a C-shaped split-ring which is made by cutting a part of a ring-shaped conductor in the circumferential direction thereof is known. The split-ring resonator can control effective permeability by interacting with a magnetic field.

As an antenna with the split-ring resonator, a technology of Patent Literature 1 is disclosed.

CITATION LIST

Patent Literature

[PTL 1]
Japanese Unexamined Patent Application (Translation of PCT Application) No. 2011-525721

SUMMARY OF INVENTION

Technical Problem

In an electronic device with a communication function, miniaturization thereof is always required and an antenna in charge of communication also requires miniaturization. A technology, which miniaturizes an antenna by using the split-ring resonator, is proposed.

From the research result of the inventor, it has been found that multilayer arrangement is effective for miniaturization. An antenna in which pattern drawing is performed on a multilayer print substrate is expensive. Though an antenna in which pattern drawing is performed on a single layer print substrate is not expensive, miniaturization thereof is difficult.

The invention solves the above-mentioned problem, and an object thereof is to provide an antenna and an electronic device which are compact and can be manufactured inexpensively.

Solution to Problem

The antenna of the invention which solves the above-mentioned problem includes a split-ring resonator which includes a first split-ring section which is formed, in a substantially C-shaped manner, in a first conductor layer located on one side of a dielectric layer, a second split-ring section which is formed, in a substantially C-shaped manner, in a second conductor layer located on the other side of the dielectric layer so as to face the first split-ring section and sandwich the dielectric layer, and a plurality of through holes which are arranged, at predetermined intervals, in the circumferential direction of C-shaped sections in the first split-ring section and the second split-ring section, and electrically connect the first split-ring section with the second split-ring section. In the above antenna, a first split section is formed at an opening of the substantially C-shaped section of the first split-ring section, a second split section is formed at an opening of the substantially C-shaped section of the second split-ring section, and the first split section and the second split section form a split to work as a capacitor.

The electronic device of the invention which solves the above-mentioned problem includes the above-described antenna.

Advantageous Effects of Invention

In the invention, even in the two-layer structure, miniaturization can be achieved at the same level as the multilayer (e.g. six-layer) structure. Further it is inexpensive compared with the multilayer structure.

If the invention is applied to the multilayer (three or more layers) structure, further miniaturization can be achieved compared with an existing multilayer structure. It can be manufactured at the same price as that of the existing multilayer structure.

If the size and the price of the antenna are reduced, further the size and the price of the electronic device with the antenna can be reduced.

DESCRIPTION OF EMBODIMENTS

First Exemplary Embodiment

~Structure~

Figure 1:
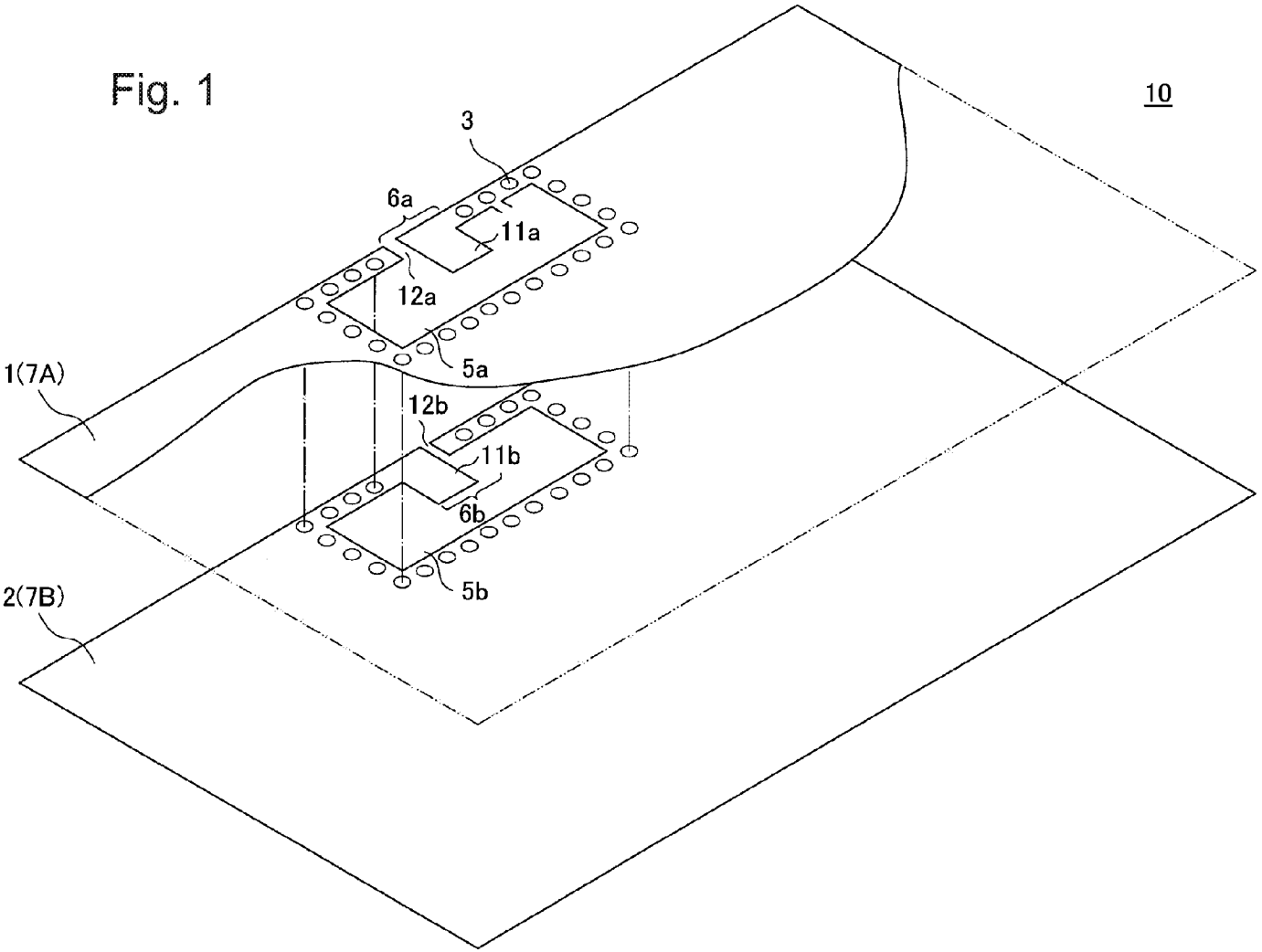
FIG. 1 a schematic perspective view of an antenna of a first exemplary embodiment, FIG. 2 a schematic plan view and a layer exploded view (first exemplary embodiment), FIG. 3 a schematic sectional view (first exemplary embodiment), FIG. 4 a detailed sectional view of an auxiliary conductor pattern (first exemplary embodiment), FIG. 5 a diagram illustrating an impedance property of the antenna, FIG. 6 a diagram illustrating a return loss property, FIG. 7 a diagram illustrating a relation between the return loss and matching loss of a wireless circuit, FIG. 8 a diagram in which a split-ring resonator and a feeding point are simplified and an electrically equivalent circuit diagram, FIG. 9 a plan view of a comparison example 1, FIG. 10 a plan view (layer exploded view) of a comparison example, FIG. 11 a detailed sectional view of an auxiliary conductor pattern (comparison example 2), FIG. 12 a schematic perspective view of an antenna of a second exemplary embodiment, FIG. 13 a schematic plan view and a layer exploded view (second exemplary embodiment)
Figure 2:
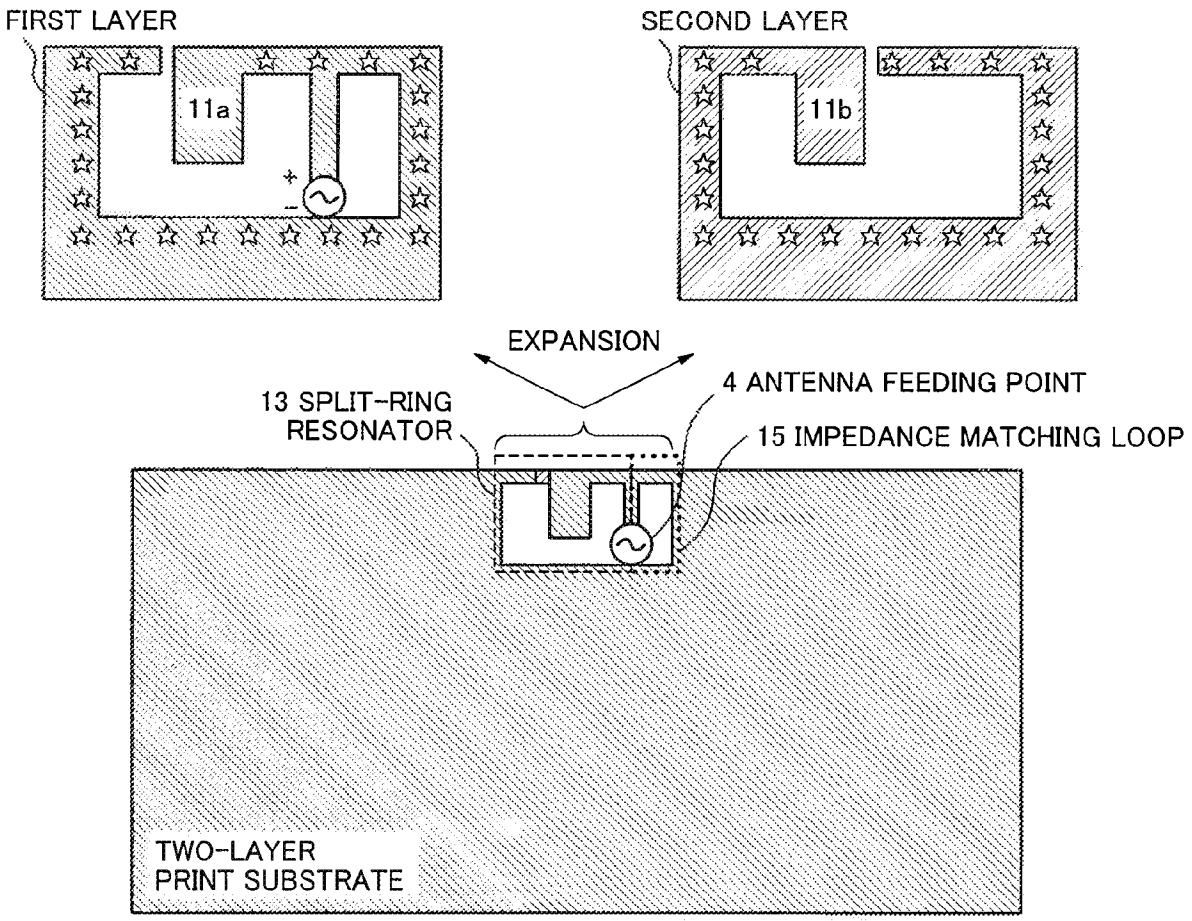
Figure 3:
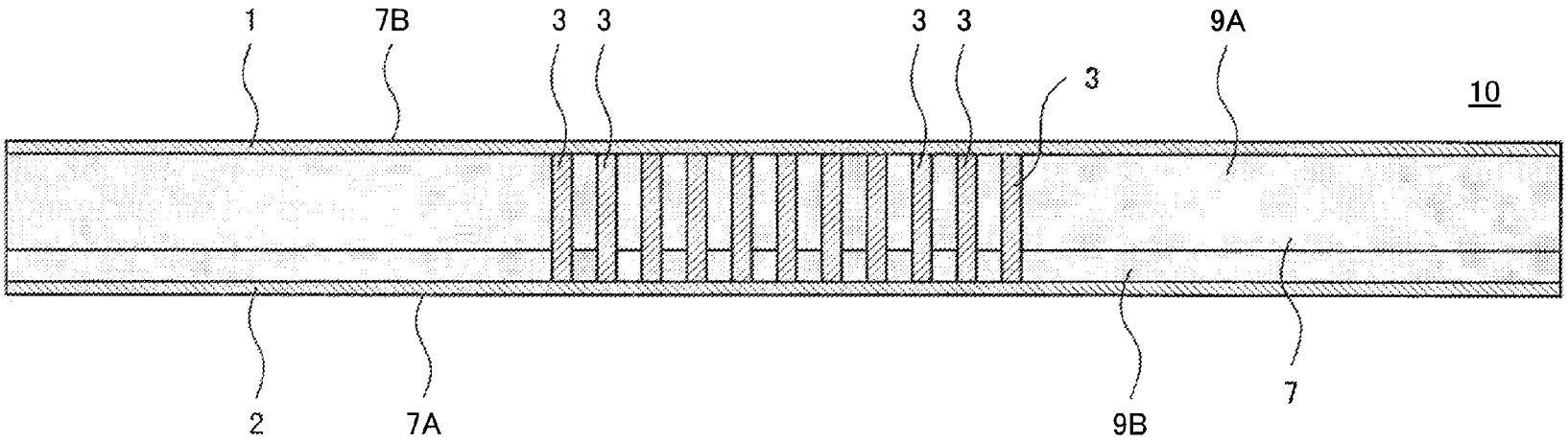
Figure 4:
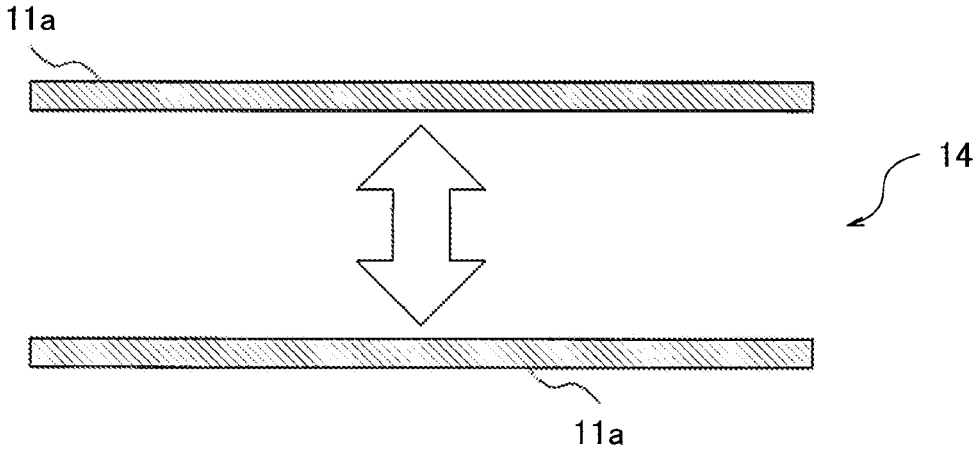

A structure of an exemplary embodiment of the invention is described in detail by referring to drawings. FIG. 1 is a schematic perspective view of an antenna of a first exemplary embodiment of the invention. FIG. 2 is a schematic plan view. In FIGS. 1 and 2, in order to illustrate a structure of inner layers, a dielectric layers 9A and 9B in a dielectric multilayer substrate 7 are omitted. The schematic plan view of FIG. 2 illustrates a general view and the details of a first split section 6*a* and a second split section 6*b* by taking a two-layer apart. FIG. 3 is a schematic sectional view and FIG. 4 is a detailed sectional view of an auxiliary conductor pattern.

An antenna 10 includes the dielectric multilayer substrate 7 in which the dielectric layers 9A and 9B are laminated. A first split-ring section 1 is formed in a conductor layer (first conductor layer) 7A and a second split-ring section 2 is formed in a conductor layer (second conductor layer) 7B.

At least parts of the first split-ring section 1 and the second split-ring section 2 are arranged so as to sandwich the dielectric layers 9A and 9B and face each other.

Each of the first split-ring section 1 and the second split-ring section 2 has a C-shaped section, and the C-shaped section includes an opening section thereinside.

A rectangular opening section 5*a* is formed in the first split-ring section 1. A rectangular opening section 5*b* which is similar to the opening section 5*a* is formed in the second split-ring section 2. The opening sections 5*a* and 5*b* continue to a substantially C-shaped opening section. When being seen from the direction orthogonal to the surface of the dielectric multilayer substrate 7, the opening sections 5*a* and 5*b* are formed so as to overlap on each other.

The split section (first split section) 6*a* is formed at the substantially C-shaped opening section which continues to the opening section 5*a*. The split section (second split section) 6*b* is formed at the substantially C-shaped opening section which continues to the opening section 5*b*.

The split section 6*a* includes an auxiliary conductor pattern (first auxiliary conductor pattern) 11*a* which is formed at one end of a substantially C-shaped section of the first split-ring section, and a split (first split) 12*a* which is formed between an end side of the auxiliary conductor pattern 11*a* and the other end of the substantially C-shaped section.

The split section 6*b* includes an auxiliary conductor pattern (second auxiliary conductor pattern) 11*b* which is formed at one end of a substantially C-shaped section of the second split-ring section, and a split (second split) 12*b* which is formed between an end side of the auxiliary conductor pattern 11*b* and the other end of the substantially C-shaped section.

The auxiliary conductor pattern 11*b* is formed so as to face the auxiliary conductor pattern 11*a*. From a top view (when being seen from the direction orthogonal to the surface of the dielectric multilayer substrate 7), the auxiliary conductor pattern 11*a* and the auxiliary conductor pattern 11*b* overlap on each other.

Though it is preferable that the whole of the auxiliary conductor pattern 11*b* is formed so as to face the auxiliary conductor pattern 11*a*, a part of the auxiliary conductor pattern 11*b* may be formed so as to face the auxiliary conductor pattern 11*a*.

In the drawings, the auxiliary conductor patterns 11*a* and 11*b* are rectangular and arranged so as to cut into the substantially C-shaped section, however not limited thereto.

The split 12*b* is formed so as to be opposite from the position facing the split 12*a* and sandwich the auxiliary conductor pattern 11*b* therebetween. From a top view, the split 12*a* and the split 12*b* sandwich the auxiliary conductor patterns 11*a* and 11*b* therebetween and are located at symmetrical positions.

If the above structure is explained in other words, the first split-ring section 1 and the second split-ring section 2 are structured in a bilaterally symmetrical manner from a top view.

From a top view, a plurality of through holes 3 are formed around the opening section 5*a* and the opening section 5*b* so as to surround the opening section 5*a* and the opening section 5*b*. The plurality of through holes 3 penetrate the dielectric layers 9A and 9B to electrically connect the first split-ring section 1 with the second split-ring section 2.

An antenna feeding point 4 is a point which connects (feed) a micro strip line transmitting a radio wave without loss and connects (feed) (+) (−) of a coaxial cable, and is the start of the antenna. A pattern for a first layer split is located in the side of the feeding point (+), and a pattern for a second layer split is located in the side of the feeding point (−).

The first split-ring section 1, the second split-ring section 2, and a feeding line are generally formed by using copper foil, may be formed by using the other materials having conductivity, and may be formed by using the same material or different materials.

The dielectric multilayer substrate 7 is a multilayer substrate (here, two layers) and may be formed using any material and any process. The dielectric multilayer substrate 7 may be, for example, a print substrate made of glass epoxy resin, an interposer substrate, like an LSI, a module substrate made of a ceramic material, like LTCC (Low Temperature Co-fired Ceramic), or a semiconductor substrate made of single crystal silicon.

In a dotted line in the left side of FIG. 2, a split-ring resonator 13 is formed. In this case, a split 14 is formed between the auxiliary conductor pattern 11*a* of the split section 6*a* and the auxiliary conductor pattern 11*b* of the split section 6*b*, and works as a large-capacity capacitor between the two layers (described below).

In a dotted line in the right side of FIG. 2, an impedance matching loop 15 is formed. The impedance matching loop 15 makes impedance matching between the antenna 10 and a wireless circuit (not shown) even better.

A capacitor with the split 12*a* works, however, the capacitor with the split 14 has capacity larger than that of the capacitor with the split 12*a*. The same goes for a capacitor with the split 12*b*. Effects based on the splits 12*a* and 12*b* are omitted below.

~Operation~

In the antenna 10 with the above structure, inductance L which is generated by a current which flows in the first split-ring section 1 and the second split-ring section 2 in an annular manner and capacitance C which is generated in the split sections 6*a* and 6*b* (in particular, auxiliary conductor patterns 11*a* and 11*b*) form an LC series resonance circuit (split-ring resonator 13), and thereby the antenna 10 works as an antenna at a frequency near the resonance frequency.

High frequency signals are fed to the split-ring resonator from a RF (Radio Frequency) circuit through the antenna feeding point 4.

The antenna feeding point 4 includes the feeding point (+) side and the feeding point (−) side, in which, for example, the auxiliary conductor pattern 11*a* is charged positive and the auxiliary conductor pattern 11*b* is charged negative, and works as a capacitor between the two layers through the split 14 (thick arrow illustrated in FIG. 4).

~Demonstrative Test~

Figure 5:
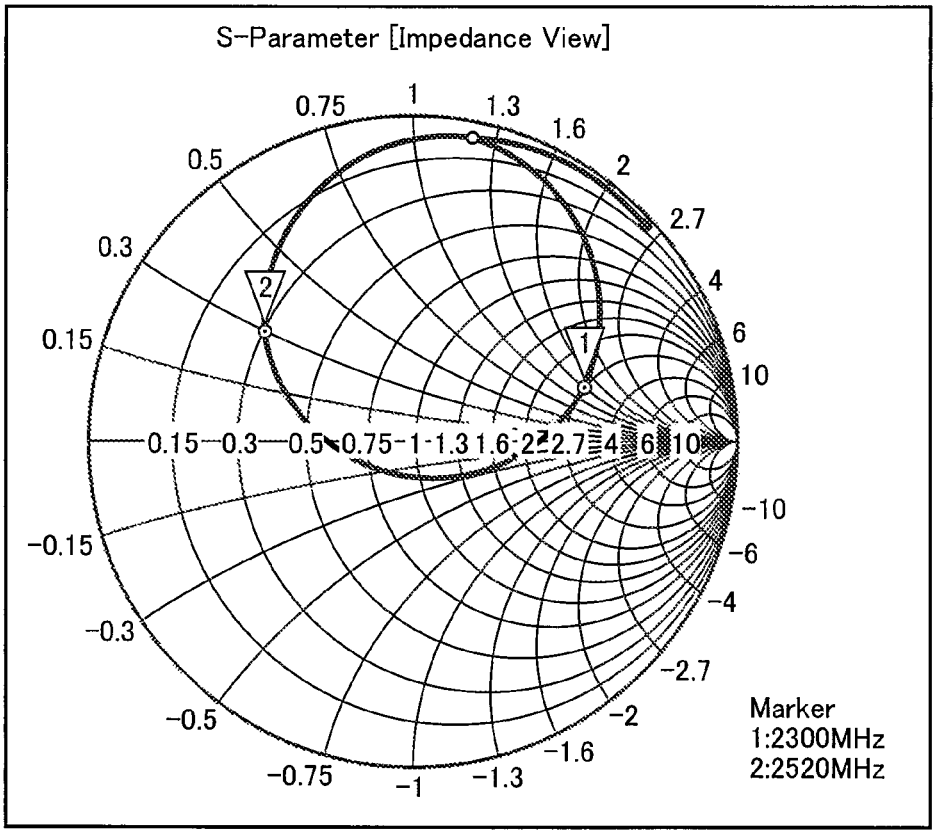
Figure 6:
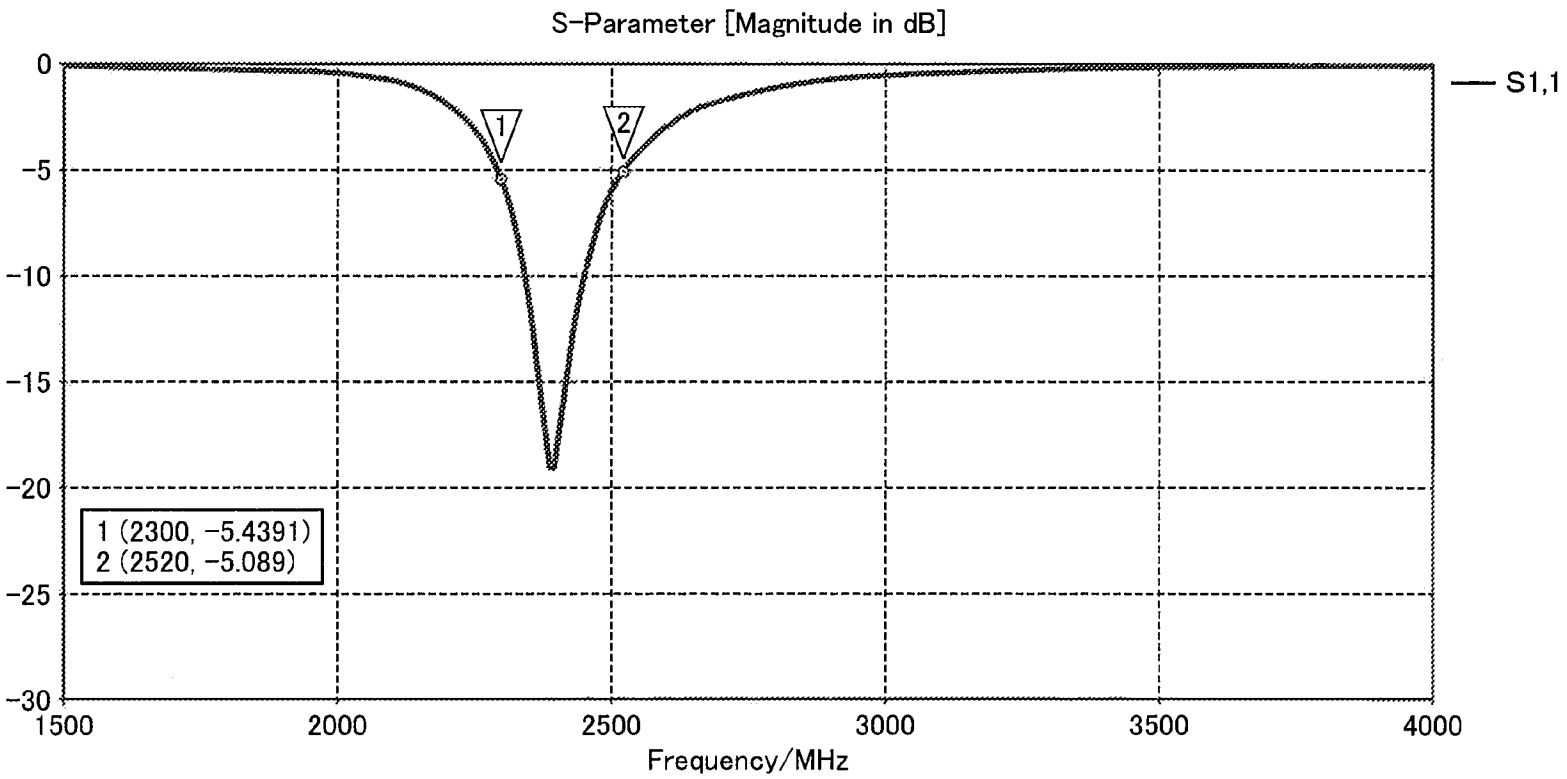

FIG. 5 illustrates the impedance property of the antenna 10 and FIG. 6 illustrates the return loss property. Both properties are acquired by measuring the antenna from the feeding point 4 using a network analyzer.

The impedance property is one viewpoint from which behavior of an antenna at high frequency is seen and is drawn in the Smith chart. When approaching 50Ω of a center of the Smith chart circle (place 1 of circle center), the antenna property is improved and matching with the circuit side is also improved. In FIG. 5, it approaches the place 1 of the circle center between a marker 1 (2300 MHz) and a marker 2 (2520 MHz) (about 2400 MHz).

The return loss is given by performing measurement as the same as that of impedance, and only chart (graph) thereof is different. FIG. 6 shows that the return loss is decreased as it approaches 50Ω. In FIG. 6, it is found that the illustrated valley portion (about 2400 MHz) is close to 50Ω and the antenna property and matching between the circuit and the antenna are improved. A frequency which corresponds to the valley which is formed between the marker 1 (2300 MHz) and the marker 2 (2520 MHz) is called the resonance frequency of the antenna. Excellent antenna performance is achieved by approaching the resonance frequency.

The above example is an example in which a WiFi (Wireless Fidelity) antenna is designed. The antenna has a resonance frequency between 2400 MHz and 2500 MHz.

Figure 7:
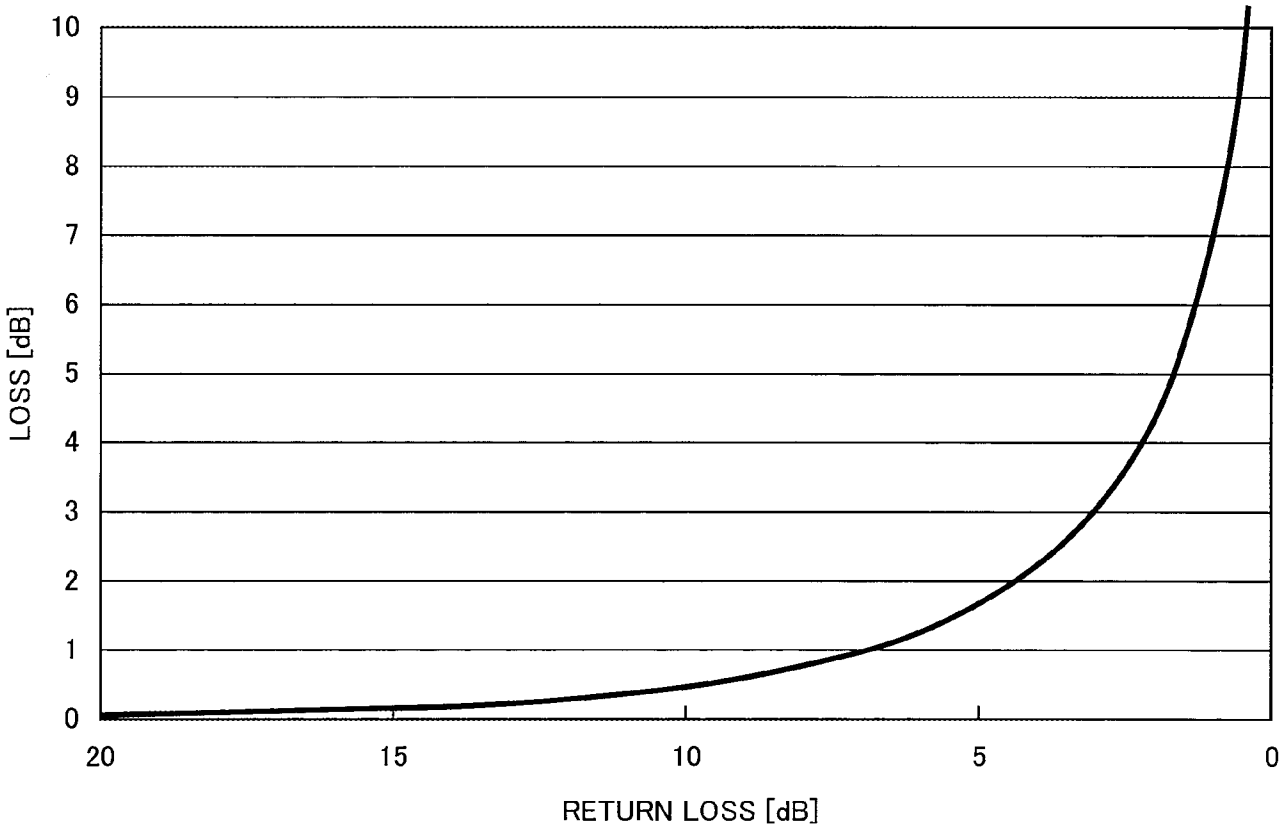

FIG. 7 illustrates the relation between the return loss and the matching loss with the wireless circuit. Since the matching loss is rapidly increased when the return loss reaches or exceeds 5 dB, design is carried out so that the return loss is less than 5 dB. In FIG. 6, since the return loss is less than 5 dB between the marker 1 (2300 MHz) and the marker 2 (2520 MHz), it can be determined that the antenna includes sufficient performance as a WiFi antenna.

~Fundamental Principle~

Figure 8:
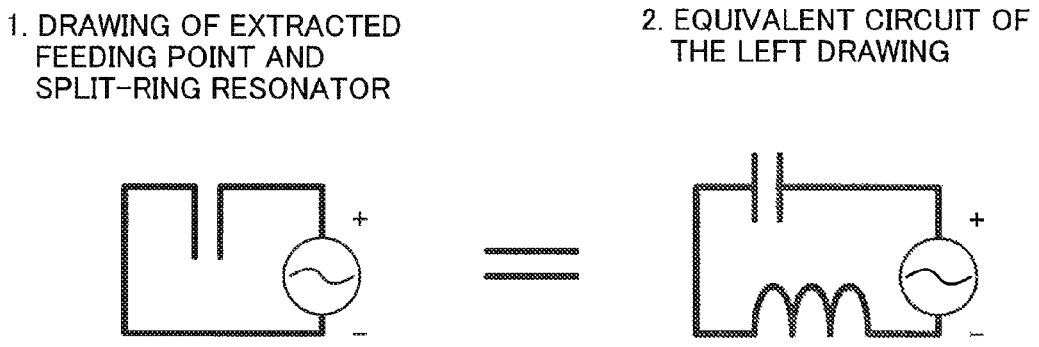

The reason why the antenna can be miniaturized is explained. FIG. 8 is a diagram in which the split-ring resonator 13 and the feeding point 4 are simplified and an electrically equivalent circuit diagram. FIG. 8-1 is the diagram in which the split-ring resonator 13 and the feeding point 4 are simplified. FIG. 8-2 illustrates the electrically equivalent circuit diagram. The split section works as a capacitor. The pattern length (ring) except the split section works as a coil. FIG. 8-2 is just a series resonance circuit diagram with a capacitor and a coil from a viewpoint of the feeding point.

The series resonance frequency is $f=1/[2\pi*\sqrt{(L*C)}]$, and the frequency is the antenna resonance frequency. If the series resonance frequency f is constant, when the capacitance C is increased, the inductance L can be decreased.

In other words, if the pattern width (area) of the auxiliary conductor patterns 11*a* and 11*b* is increased, capacitor capacitance is increased and a coil, i.e. pattern length can be decreased. As a result, a compact antenna can be achieved.

If the pattern widths (area) of the auxiliary conductor patterns 11*a* and 11*b* are adjusted, the series resonance frequency f can be adjusted based on the same principle. If the capacitance C is increased, the frequency can be lowered.

~Effect~

By compared with comparison examples 1 and 2, the effect of the exemplary embodiment is described.

Figure 9:
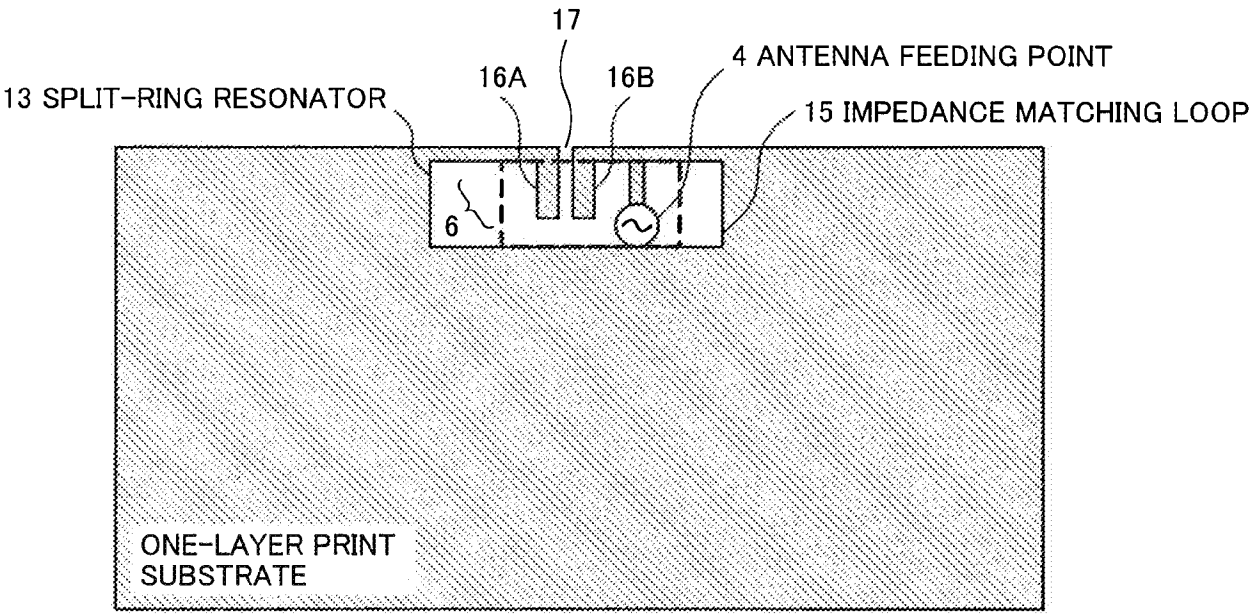

FIG. 9 is a plan view of the comparison example 1. The comparison example 1 is an antenna in which pattern drawing is performed on a single layer print substrate. A split section 6 includes an auxiliary conductor pattern 16A which is formed on one end of a substantial C-shaped section, an auxiliary conductor pattern 16B which is formed on the other end of the substantial C-shaped section, and a split 17 which is formed between the auxiliary conductor pattern 16A and the auxiliary conductor pattern 16B.

The auxiliary conductor pattern 16A and the auxiliary conductor pattern 16B face each other in the same layer through the split 17, and the split section 6 works as a capacitor. A split-ring section is formed of very thin copper foil, and it is difficult for the split section 6 formed in the same layer to secure capacitor capacitance.

On the one hand, the exemplary embodiment is an antenna in which patter drawing is performed on a two-layer print substrate. The split sections 6*a* and 6*b* (in particular, auxiliary conductor patterns 11*a* and 11*b*) can increase capacitor capacitance.

Thereby the exemplary embodiment can be miniaturized compared with the comparison example 1. An area which is surrounded by a dotted line section in FIG. 9 corresponds to the size of the split-ring resonator 13 and the impedance matching loop 15 of the exemplary embodiment. It is understood that the size can be greatly decreased.

Figure 10:
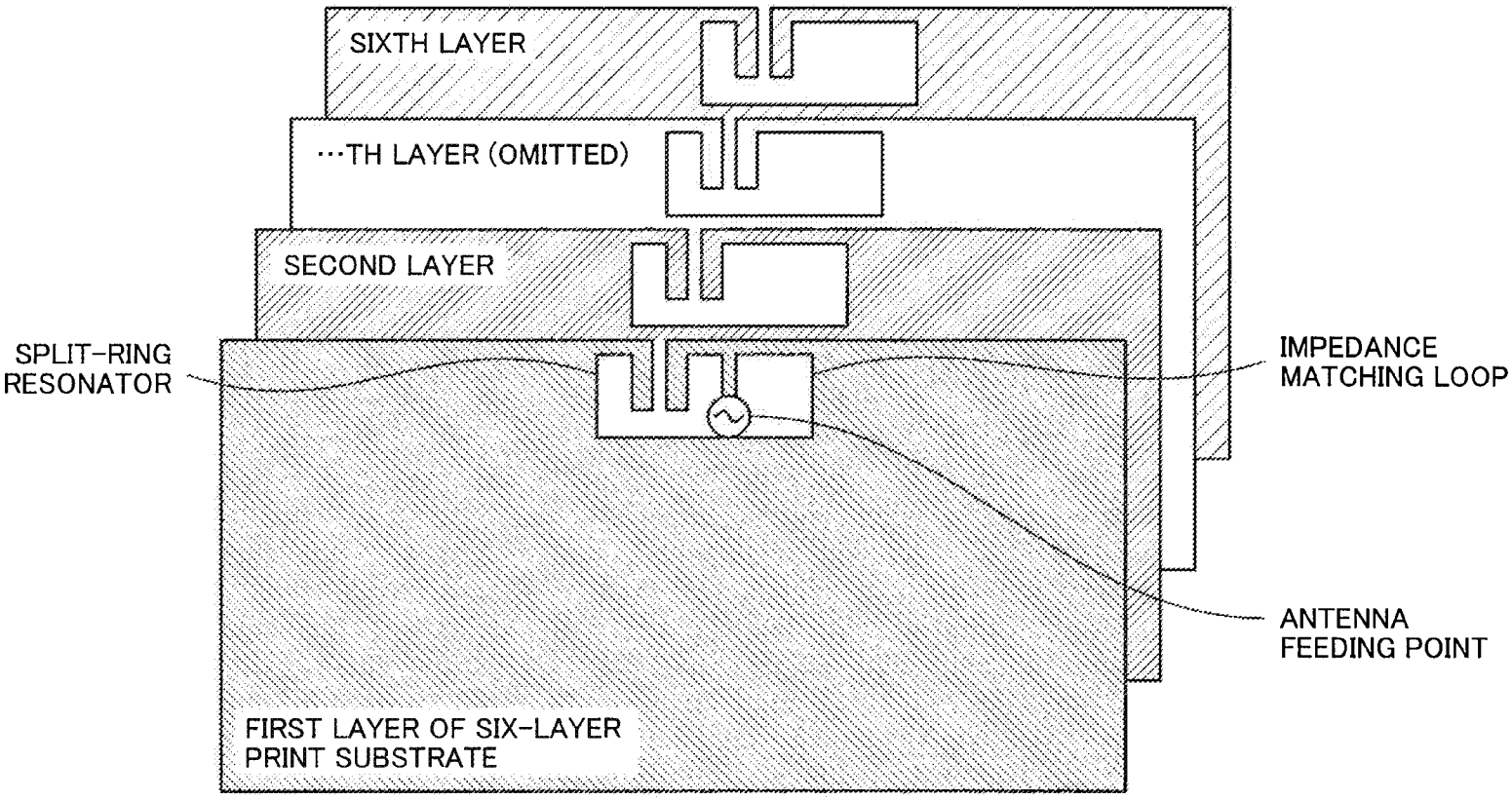
Figure 11:
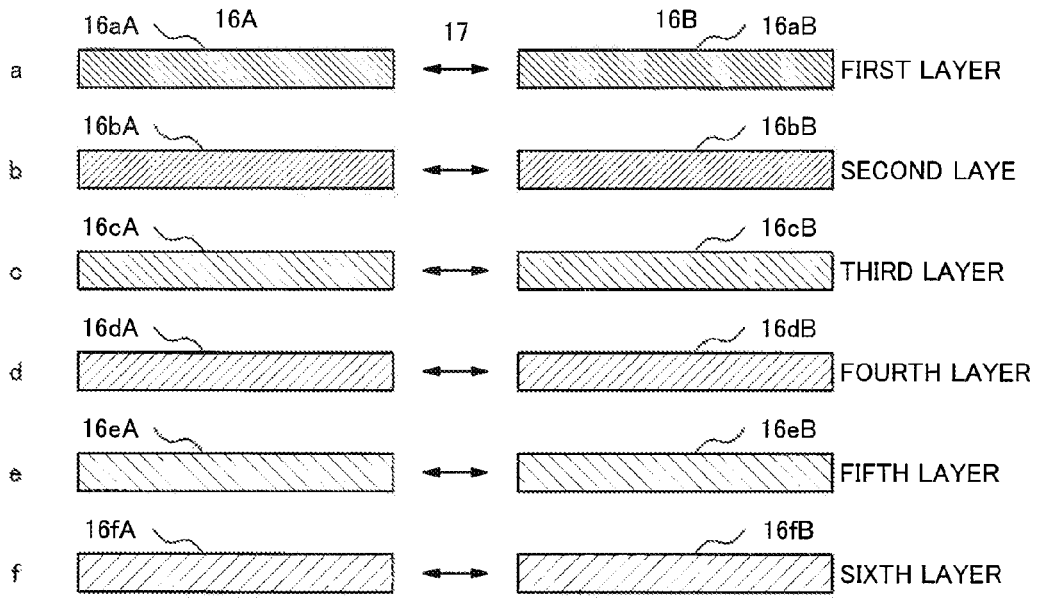
Figure 11:
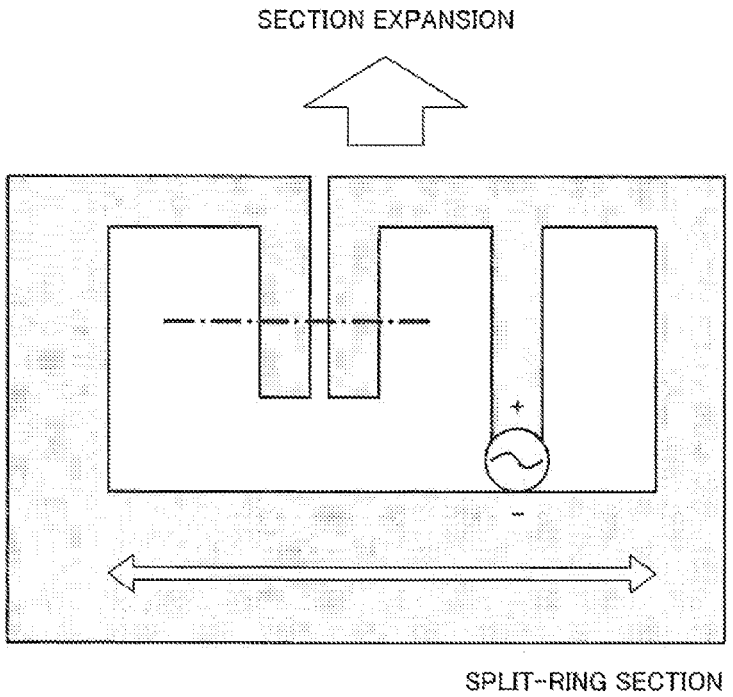

FIG. 10 is a plan view of the comparison example 2. The comparison example 2 is an antenna in which pattern drawing is performed on a multilayer print substrate. It is a laminated one (six layers in the illustration) of the comparison example 1. In order to understand an outline of the comparison example 2, the lamination is taken apart to be illustrated. FIG. 11 is a detailed sectional view of an auxiliary conductor pattern of the comparison example 2. A plan view illustrating a cutting part is also illustrated. In an auxiliary conductor pattern 16, a left side in the illustration is a side A and a right side in the illustration is a side B. A first layer to a sixth layer have corresponding reference signs a to f, respectively. Capacitor capacitance (illustrated thin arrow) can be increased due to multilayer arrangement. As a result, miniaturization can be achieved like the exemplary embodiment.

However, the antenna in which pattern drawing is performed on the multilayer print substrate is costly.

The exemplary embodiment is the antenna in which pattern drawing is performed on the two-layer print substrate. The antenna having the same performance and the same size as those of the comparison example 2 (six layers) can be realized by using two layers. The antenna which is similar to the comparison example 2 can be manufactured inexpensively compared with the comparison example 2.

As mentioned above, according to the antenna of the first exemplary embodiment of the invention, the two-layer structure can be miniaturized at the same level as the multilayer (e.g. six layers) structure. It is low-cost compared with the multilayer structure. If the size and the price of the antenna are reduced, it is possible to make the electronic device with the antenna miniaturized and inexpensive.

Second Exemplary Embodiment

Figure 12:
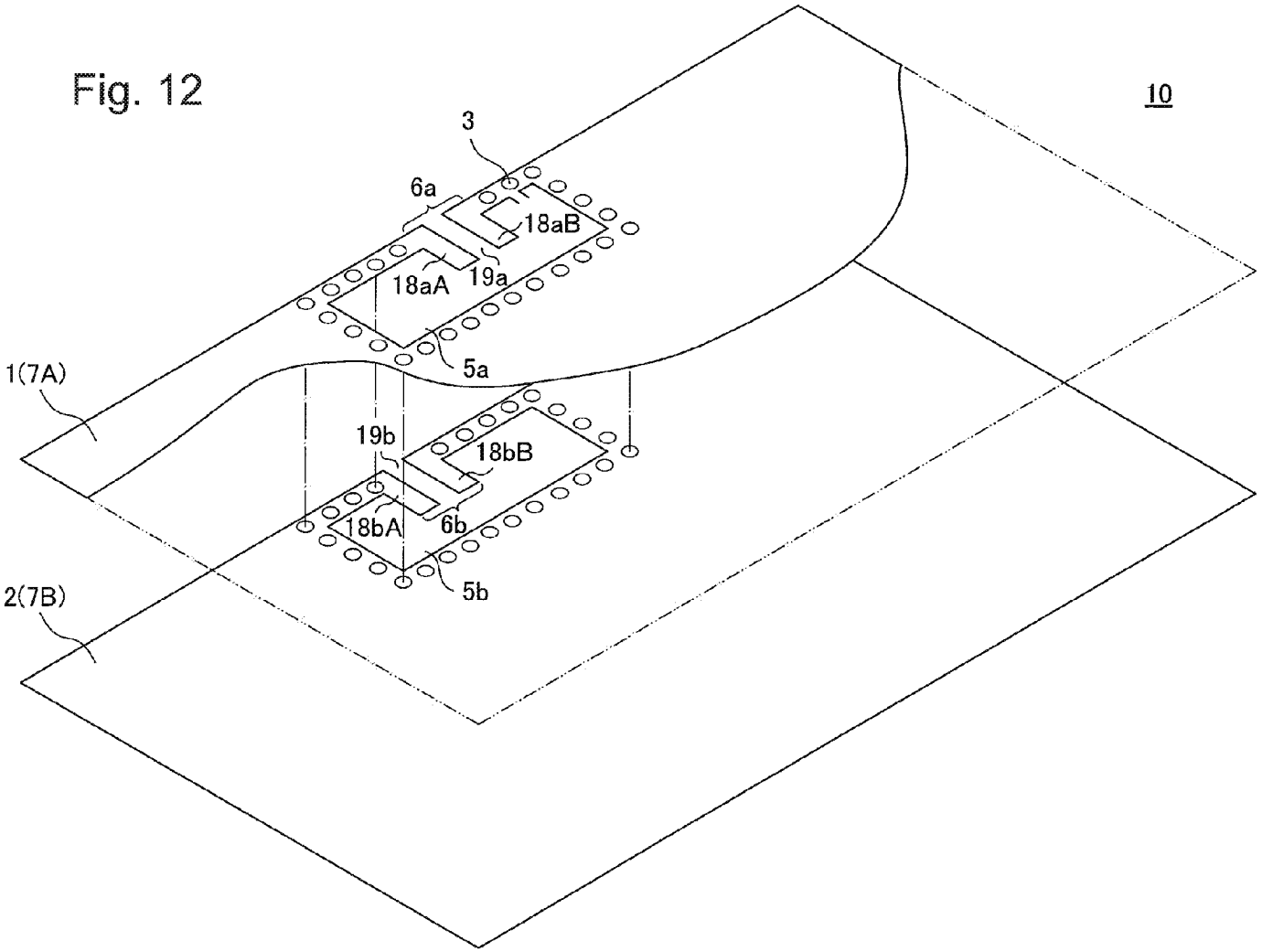
Figure 13:
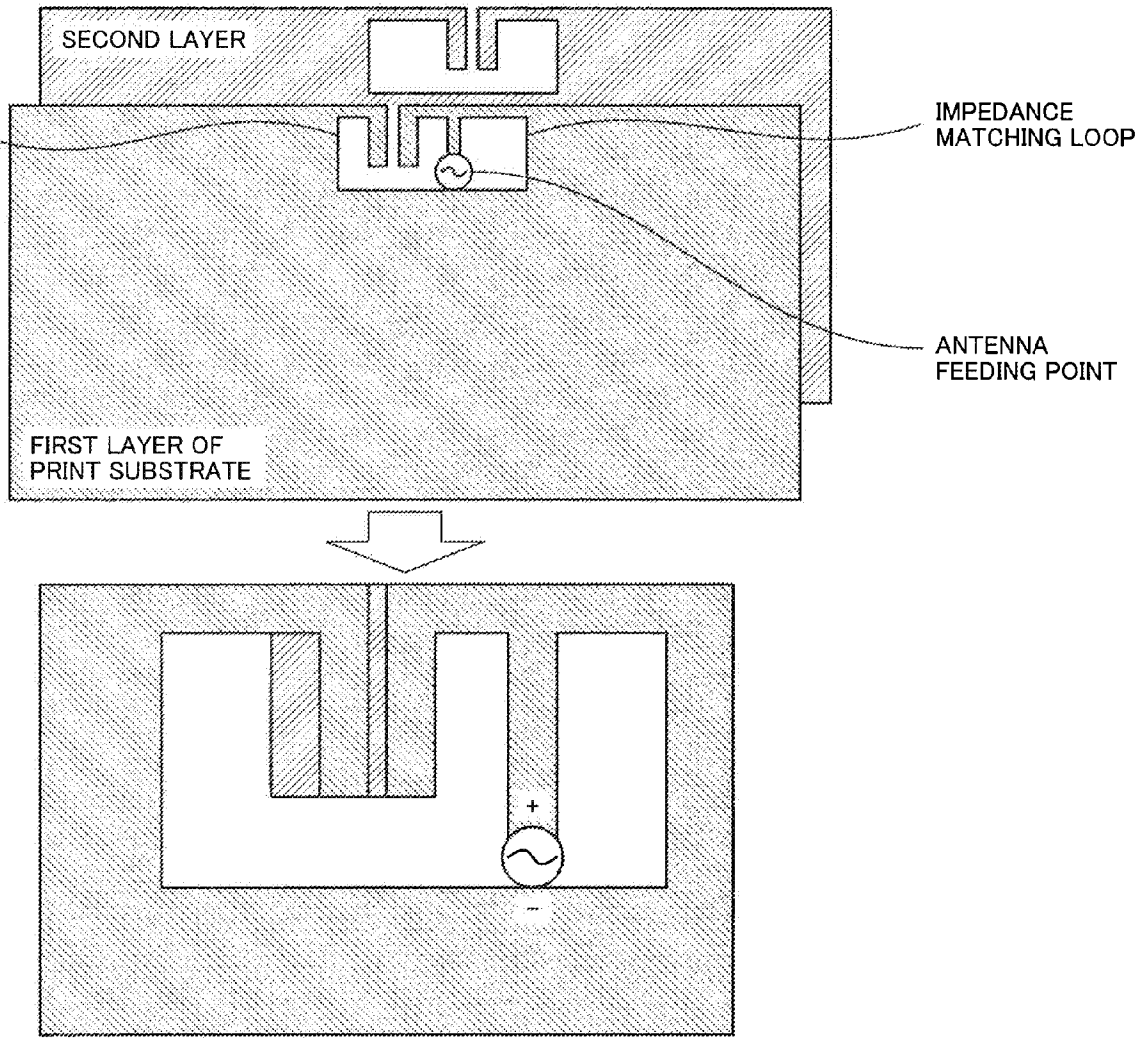
Figure 14:
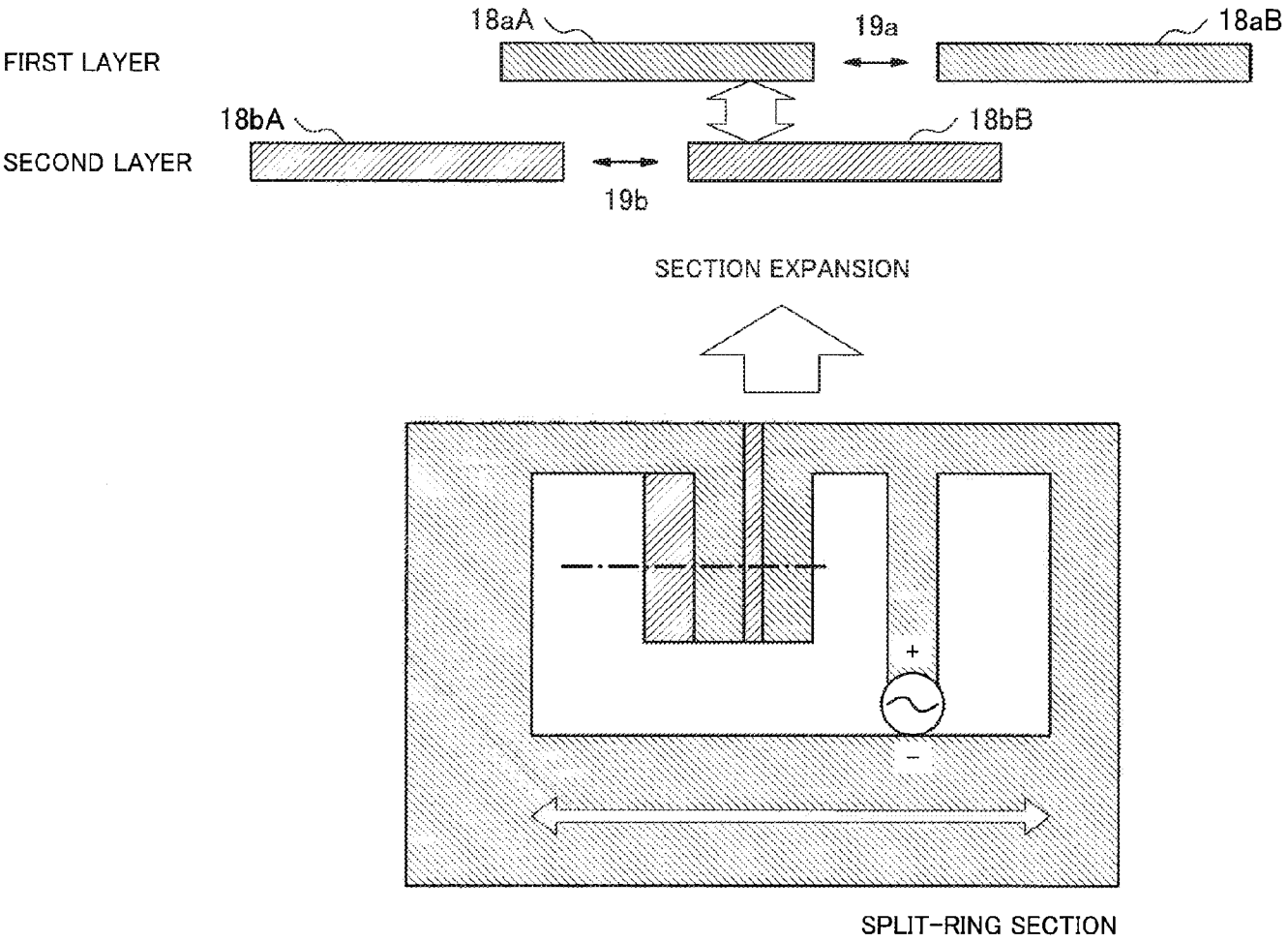
FIG. 14 a detailed sectional view of an auxiliary conductor pattern (second exemplary embodiment), FIG. 15 a schematic plan view (layer exploded view) (third exemplary embodiment), FIG. 16 a detailed sectional view of an auxiliary conductor pattern (third exemplary embodiment), FIG. 17 a schematic plan view and a layer exploded view (fourth exemplary embodiment), FIG. 18 a detailed sectional view of an auxiliary conductor pattern (fourth exemplary embodiment).

FIG. 12 is a schematic perspective view of an antenna of a second exemplary embodiment. FIG. 13 is a schematic plan view. In FIG. 12 and FIG. 13, the dielectric layers 9A and 9B of the dielectric multilayer substrate 7 are omitted in order to illustrate an inner layer structure. The schematic plan view (FIG. 13) illustrates a general view and details of the first split section 6*a* and the second split section 6*b* by taking a two-layer apart. FIG. 14 is a detailed sectional view of an auxiliary conductor pattern. In FIG. 14, a plan view illustrating a cutting part is also illustrated.

A general structure of the second exemplary embodiment is in common with the first exemplary embodiment. Detailed structures of the split section (first split section) 6*a* and the split section (second split section) 6*b* are different.

The split section 6*a* includes an auxiliary conductor pattern 18*a*A formed on one end of a substantially C-shaped section (third A auxiliary conductor pattern), an auxiliary conductor pattern 18*a*B formed on the other end of a substantially C-shaped section (third B auxiliary conductor pattern), and a split 19*a* (third split) formed between the auxiliary conductor pattern 18*a*A and the auxiliary conductor pattern 18*a*B.

The split section 6*b* includes an auxiliary conductor pattern 18*b*A formed on one end of a substantially C-shaped section (fourth A auxiliary conductor pattern), an auxiliary conductor pattern 18*b*B formed on the other end of a substantially C-shaped section (fourth B auxiliary conductor pattern), and a split 19*b* (fourth split) formed between the auxiliary conductor pattern 18*b*A and the auxiliary conductor pattern 18*b*B.

The auxiliary conductor pattern 18*b*B is formed so as to face the auxiliary conductor pattern 18*a*A.

As illustrated, a part of the auxiliary conductor pattern 18*b*B may be formed so as to face the auxiliary conductor pattern 18*a*A, and the whole thereof may be advantageously formed so as to face that. Thereby, capacitor capacitance can be increased.

In the illustrations, the auxiliary conductor patterns 18*a*A, 18*a*B, 18*b*A and 18Bb are rectangular and arranged so as to cut into the substantially C-shaped section. They are not limited thereto.

From a top view, the split 19*a* and the split 19*b* are arranged so as to get out of position.

In the other words, the first split-ring section 1 and the second split-ring section 2 are formed in a bisymmetric manner from a top view.

In the second exemplary embodiment, the split-ring resonator 13 is formed. A split 20 is formed between the auxiliary conductor pattern 18*a*A of the split section 6*a* and the auxiliary conductor pattern 18*b*B of the split section 6*b*, and works as a large-capacity capacitor between the two layers (thick arrow illustrated in the upper drawing in FIG. 14).

When power is supplied from the antenna feeding point 4, the auxiliary conductor pattern 18*a*A and the auxiliary conductor pattern 18*b*B accumulate different charges each other.

Thereby, the second exemplary embodiment has the same effect as that of the first exemplary embodiment. It is possible to inexpensively produce a compact antenna.

Third Exemplary Embodiment

~Structure, Operation~

Figure 15:
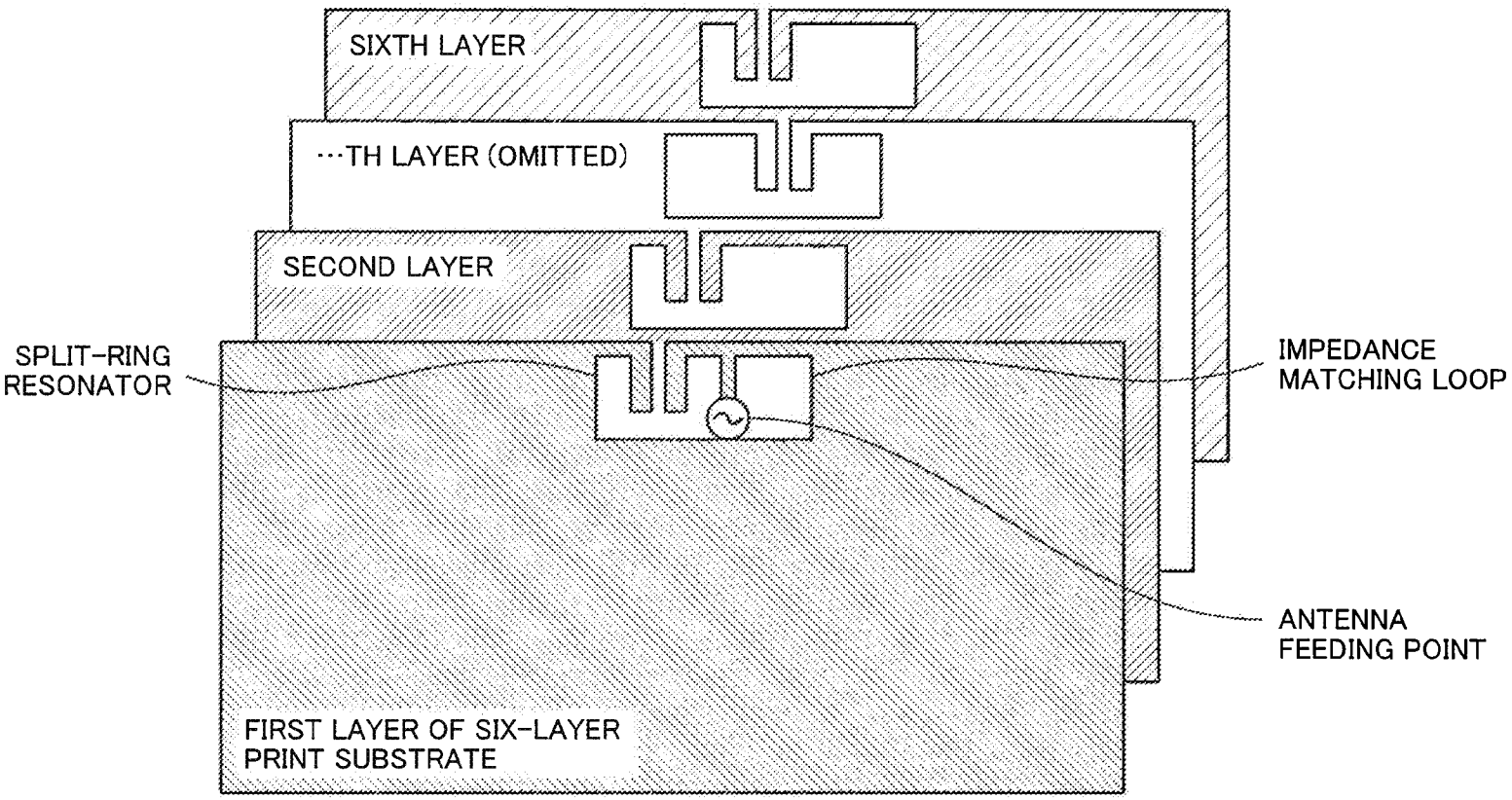
Figure 16:
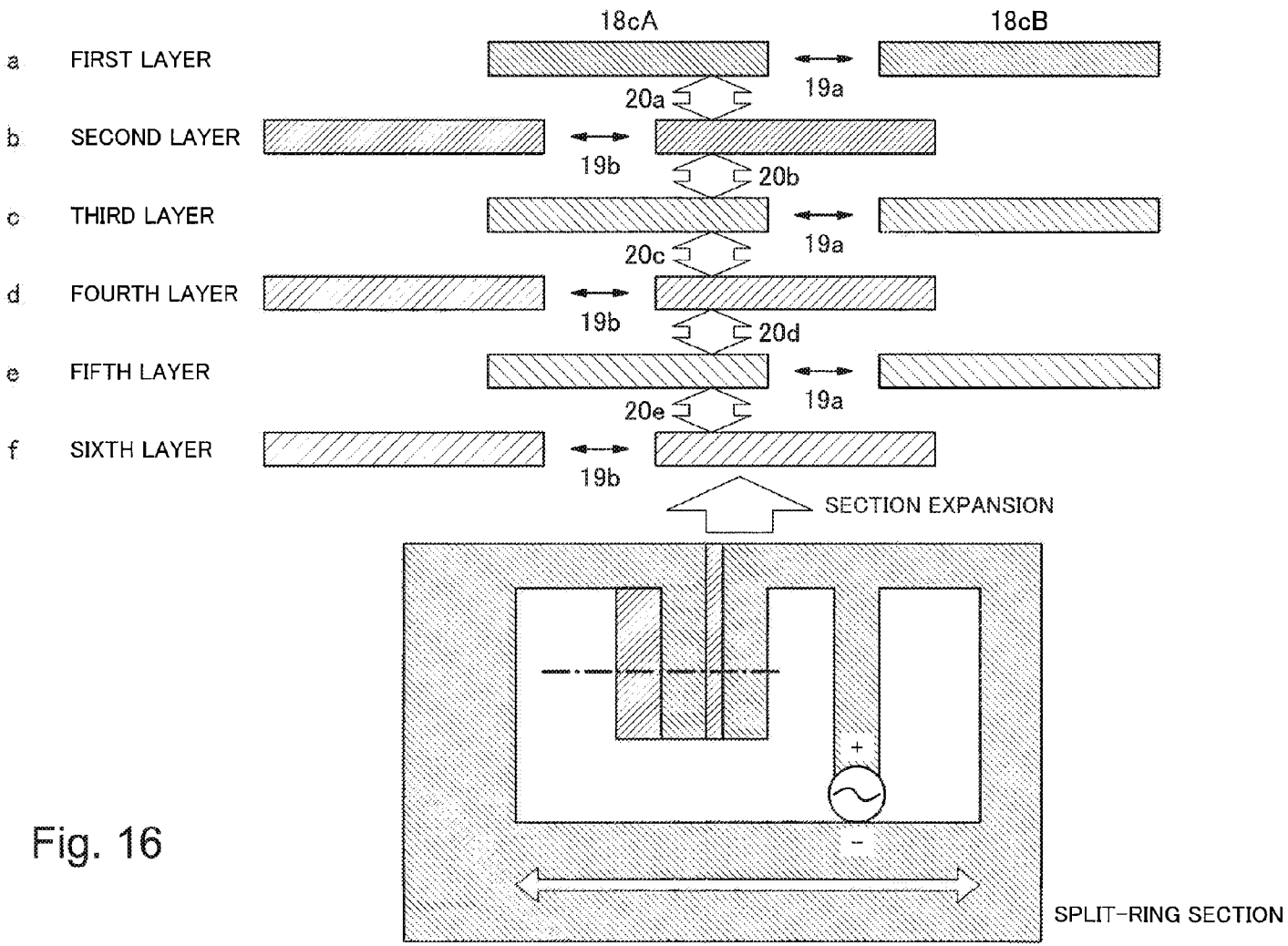

FIG. 15 is a schematic plan view of an antenna of a third exemplary embodiment. The schematic plan view illustrates a general view and lamination which is taken apart. FIG. 16 is a detailed sectional view of an auxiliary conductor pattern. In an auxiliary conductor pattern 18, a left side in the illustration is a side A and a right side in the illustration is a side B. A first layer to a sixth layer correspond to reference signs a to f, respectively. In FIG. 16, a plan view illustrating a cutting part is also illustrated.

An antenna of the third exemplary embodiment is an antenna in which the antenna of the second exemplary embodiment is laminated. The conductor layer 7A and the conductor layer 7B are alternately laminated (e.g. six layers). In other words, the split 19*a* and the split 19*b* are alternately arranged.

Further, an auxiliary conductor pattern 18*c*A is formed so as to face the auxiliary conductor pattern 18*b*B, and a split 20*b* is formed therebetween and works as a large-capacity capacitor between layers.

Splits 20*c* to 20*f* are also formed and works as large capacity capacitors between layers (illustrated thick arrow). Consequently the antenna of the third exemplary embodiment can further increase capacitor capacitance compared with the second exemplary embodiment.

~Effect~

By comparing with a comparison example 2 shown in FIG. 10 and FIG. 11, the effect of the third exemplary embodiment is described.

The comparison example 2 is one in which the comparison example 1 (refer to FIG. 9) is laminated (six layers in the illustration). In the comparison example 1, the auxiliary conductor pattern 16A and the auxiliary conductor pattern 16B face each other through the split 17 in the same layer, and the split section 6 works as a capacitor. However, a split-ring section is very thin copper foil, and it is difficult for the split section 6 formed in the same layer to secure capacitor capacitance.

In the comparison example 2, capacitor capacitance can be increased due to multilayer arrangement (illustrated thin arrow). As described below, however, it is limited to increase capacitance.

As shown in FIG. 11, in the first layer and the second layer, the auxiliary conductor pattern 16*a*A faces the auxiliary conductor pattern 16*b*A, a split is formed therebetween, and the auxiliary conductor pattern 16*a*B faces the auxiliary conductor pattern 16*b*B, a split is formed therebetween, respectively.

When power is supplied from the antenna feeding point 4, the auxiliary conductor pattern 16*a*A and the auxiliary conductor pattern 16*b*A accumulate the same charges which are positive or negative. The auxiliary conductor pattern 16*a*B and the auxiliary conductor pattern 16*b*B accumulate the same charges which are positive or negative. Therefore they do not work as a capacitor through a split. Therefore it is limited to increase capacitor capacitance.

In the antenna of the third exemplary embodiment, the splits 20*c* to 20*f* work as large-capacity capacitors. Thereby further miniaturization is possible compared with the comparison example 2. Both the comparison example 2 and the third exemplary embodiment are antennas in which pattern drawing is performed on the six-layer substrates and can be manufactured at a comparable price.

Fourth Exemplary Embodiment

Figure 17:
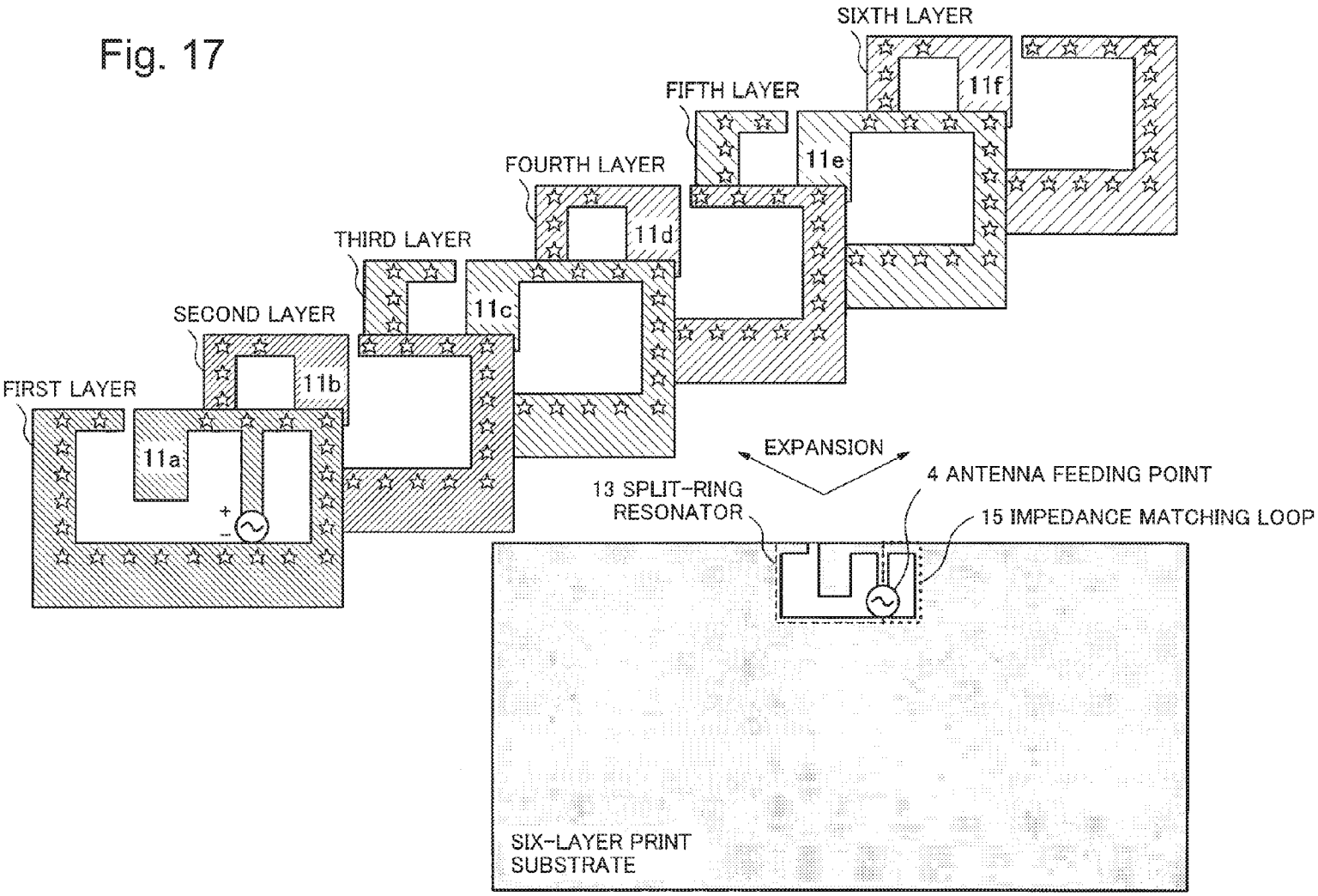
Figure 18:
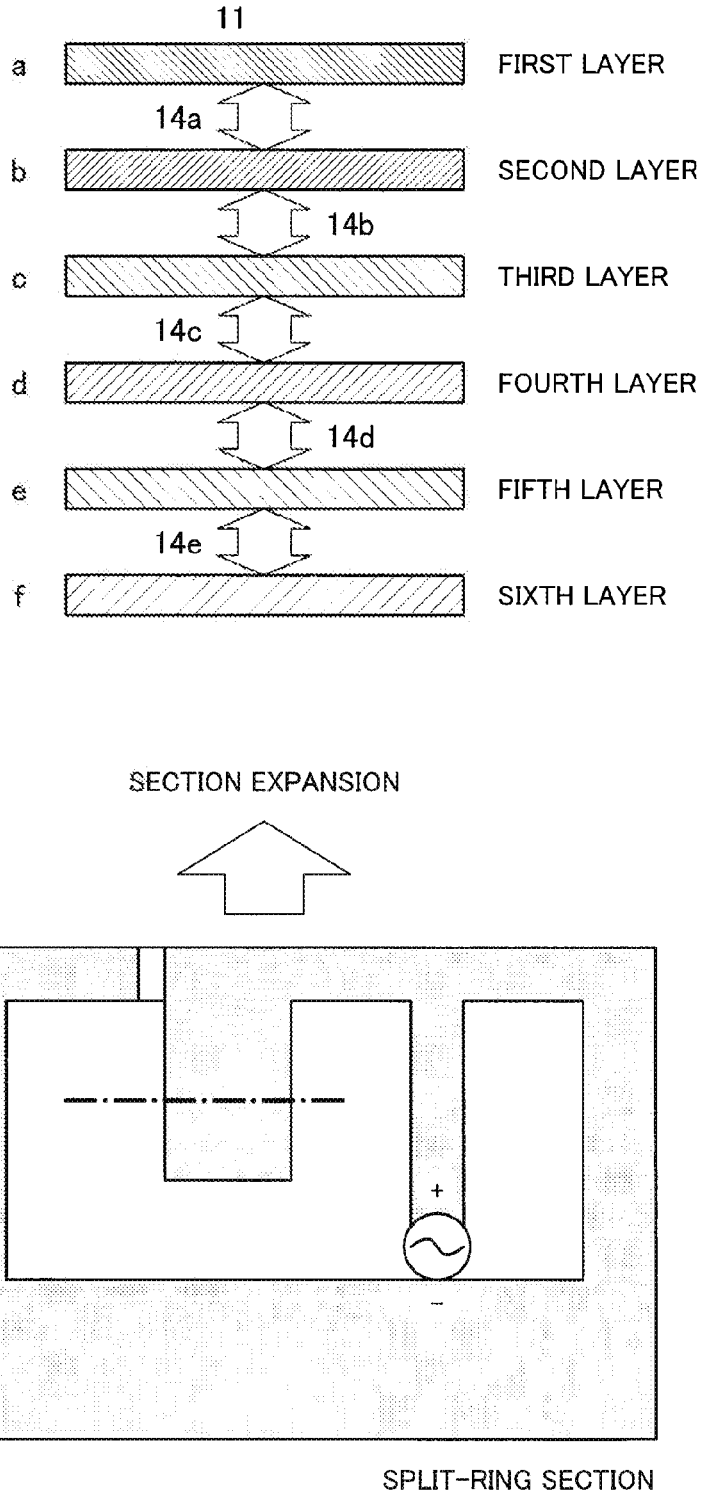

FIG. 17 is a schematic plan view of an antenna of a fourth exemplary embodiment. The schematic plan view illustrates a general view and lamination which is taken apart. FIG. 18 is a detailed sectional view of an auxiliary conductor pattern. A plan view illustrating a cutting part is also illustrated.

Though the third exemplary embodiment is one in which the second exemplary example is laminated, the fourth exemplary embodiment is one in which the first exemplary embodiment is laminated.

Thereby, as shown in FIG. 18, splits 14*a* to 14*f* are formed and work as large-capacity capacitors (illustrated thick arrow). As a result, the antenna of the fourth exemplary embodiment can further increase capacitor capacitance thereof compared with the antenna of the first exemplary embodiment.

Thereby the fourth exemplary embodiment has the effect similar to that of the third exemplary embodiment. The antenna of the fourth exemplary embodiment has the price comparable to that of the multilayer structure of Patent literature 1. While keeping the comparable price, further miniaturization can be achieved.

As described above, the antenna of the invention includes the split-ring resonator 13 having the first split-ring section 1, the substantially C-shaped second split-ring section 2, and the through holes 3. The split-ring section 1 is formed, in a substantially C-shaped manner, in the first conductor layer 7A located on one side of the dielectric layer 9. The substantially C-shaped second split-ring section 2 is formed, in a substantially C-shaped manner, in a second conductor layer 7B located on the other side of the dielectric layer 9 so as to face the first split-ring section 1 and sandwich the dielectric layer 9. The plurality of through holes 3 are arranged, at predetermined intervals, in the circumferential direction of C-shaped sections in the first split-ring section 1 and the second split-ring section 2. The through holes 3 electrically connect the first split-ring section 1 with the second split-ring section 2. The first split section 6*a* (11*a*, 18*a*A, 18*a*B) is formed at an opening of the substantially C-shaped section of the first split-ring section 1. The second split section 6*b* (11*b*, 18*b*A, 18*b*B) is formed at an opening of the substantially C-shaped section of the second split-ring section 2. The first split section and the second split section form splits (14, 20) to work as capacitors.

As described above, by feeding different charges, a large-capacity capacitor works between the first split-ring sections 1 and 2, i.e. between two layers. The split-ring resonator is a LC series resonance circuit, and if capacitance C is increased, inductance L can be decreased. Pattern length can be therefore shortened. As a result, a compact antenna can be realized.

In the antenna of the invention, the first split section 6*a* preferably includes the first auxiliary conductor pattern 11*a* which is formed on one end of the substantially C-shaped section, and the first split 12*a* which is formed between an end side of the first auxiliary conductor pattern and the other end of the substantially C-shaped section. The second split section 6*b* includes the second auxiliary conductor pattern 11*b* which is formed on one end of the substantially C-shaped section, and the second split 12*b* which is formed between an end side of the second auxiliary conductor pattern and the other end of the substantially C-shaped section. At least a part of the second auxiliary conductor pattern 11*b* is formed so as to face the first auxiliary conductor pattern 11*a*. The second split 12*b* is formed so as to be opposite from the position facing the first split and sandwich the second auxiliary conductor pattern 11*b* therebetween.

In the structure formed in a bisymmetric manner from a top view, the auxiliary conductor patterns 11*a* and 11*b* accumulate different charges and a large-capacity capacitor works between the two layers. The invention corresponds to the first exemplary embodiment and the fourth exemplary embodiment.

In the antenna of the invention, preferably the first split section 6*a* includes the third A auxiliary conductor pattern 18*a*A which is formed on one end of the substantially C-shaped section, the third B auxiliary conductor pattern 18*a*B which is formed on the other end of the substantially C-shaped section, and the third split 19*a* which is formed between the third A auxiliary conductor pattern and the third B auxiliary conductor pattern. The second split section 6*b* includes the fourth A auxiliary conductor pattern 18*b*A which is formed on one end of the substantially C-shaped section, the fourth B auxiliary conductor pattern 18*b*B which is formed on the other end of the substantially C-shaped section, and the fourth split 19*b* which is formed between the fourth A auxiliary conductor pattern and the fourth B auxiliary conductor pattern. At least a part of the fourth B auxiliary conductor pattern 18*b*B is formed so as to face the third A auxiliary conductor pattern 18*a*A.

In the structure formed in a bisymmetric manner from a top view, the auxiliary conductor patterns 18*a*A and 18*b*B accumulate different charges and a large-capacity capacitor works between the two layers. The invention corresponds to the second exemplary embodiment and the third exemplary embodiment.

In the antenna of the invention, pattern drawing is preferably performed on a two-layer print substrate.

In the invention, the two-layer structure can be miniaturized at the same level as the multilayer (e.g. six layers) structure and is inexpensive compared with multilayer structure. The invention corresponds to the first exemplary embodiment and the second exemplary embodiment.

In the antenna of the invention, further preferably pattern drawing is performed on a print substrate with three or more layers, and the first conductor layer 7A and the second conductor layer 7B are laminated alternately.

If the invention is applied to the multilayer (three or more layers) structure, further miniaturization can be achieved compared with an existing multilayer structure. It can be manufactured at the same price as that of the multilayer structure described in Patent Literature 1. The invention corresponds to the third exemplary embodiment and the fourth exemplary embodiment.

The electronic device of the invention includes the antenna 10.

The invention is described based on the above exemplary embodiments. The exemplary embodiments are exemplification, and may add various changes, addition and reduction, and combinations to the above exemplary embodiments unless they deviate from the gist of the invention. It is understood by a person ordinarily skilled in the art that the modified examples to which these changes, addition and reduction, and combinations are added are within the scope of the invention.

This application claims priority from Japanese Patent Application No. 2013-035234 filed on Feb. 26, 2013, and the contents of which are incorporation herein by reference in their entirety.

INDUSTRIAL APPLICABILITY

The invention is applicable to electronic devices having a structure which radiates heat of an electronic substrate which mounts heat generating components

REFERENCE SIGNS LIST

1 first split-ring section
2 second split-ring section

3 through hole
4 feeding point
5*a*, 5*b* opening section
6*a* split section (first split section)
6*b* split section (second split section)
6*c* split section
7 dielectric multilayer substrate
7A conductor layer (first conductor layer)
7B conductor layer (second conductor layer)
9A, 9B dielectric layer
10 antenna
11*a* auxiliary conductor pattern (first auxiliary conductor pattern)
11*b* auxiliary conductor pattern (second auxiliary conductor pattern)
11*c* to *f* auxiliary conductor pattern
12*a* split (first split)
12*b* split (second split)
13 split-ring resonator
14, 14*a* to *f* split
15 impedance matching loop
16, 16*a* to *f* split (comparison example)
17, 17*a* to *f* split (comparison example)
18*a*A auxiliary conductor pattern (third A auxiliary conductor pattern)
18*a*B auxiliary conductor pattern (third B auxiliary conductor pattern)
18*b*A auxiliary conductor pattern (fourth A auxiliary conductor pattern)
18*b*B auxiliary conductor pattern (fourth B auxiliary conductor pattern)
18Ca to Fb auxiliary conductor pattern
19*a* split (third split)
19*b* split (fourth split)
19*c* to *f* split
20, 20*a* to *f* split

The invention claimed is:

1. An antenna, comprising:

a split-ring resonator comprising:

a first split-ring section that is formed, in a substantially C-shaped manner, in a first conductor layer located on one side of a dielectric layer;

a second split-ring section that is formed, in a substantially C-shaped manner, in a second conductor layer located on the other side of the dielectric layer so as to face the first split-ring section and sandwich the dielectric layer; and a plurality of through holes that are arranged, at predetermined intervals, in the circumferential direction of C-shaped sections in the first split-ring section and the second split-ring section, and electrically connect the first split-ring section with the second split-ring section, wherein a first split section is formed at an opening of the substantially C-shaped section of the first split-ring section, a second split section is formed at an opening of the substantially C-shaped section of the second split-ring section, and the first split section and the second split section are separated by a distance across a dielectric area to work as a capacitor;

wherein the first split section comprises:

a first auxiliary conductor pattern that is formed on one end of the substantially C-shaped section; and a first split that is formed between an end side of the first auxiliary conductor pattern and the other end of the substantially C-shaped section, the second split section comprises:

a second auxiliary conductor pattern that is formed on one end of the substantially C-shaped section; and a second split that is formed between an end side of the second auxiliary conductor pattern and the other end of the substantially C-shaped section, and at least a part of the second auxiliary conductor pattern is formed so as to face the first auxiliary conductor pattern, and the second split is formed so as to be opposite from the position facing the first split and sandwich the second auxiliary conductor pattern therebetween.

2. The antenna according to claim 1, wherein pattern drawing is performed on a two-layer print substrate.

3. The antenna according to claim 1, wherein pattern drawing is performed on a substrate with three or more layers, and the first conductor layer and the second conductor layer are laminated alternately.

4. An electronic device, comprising an antenna of claim 1.

* * * * *